US008496162B2

(12) United States Patent
Hettinger et al.

(10) Patent No.: US 8,496,162 B2
(45) Date of Patent: Jul. 30, 2013

(54) CARTON AND CARTON BLANK

(75) Inventors: Peter Hettinger, Trierweiler (DE); Jean Michel Auclair, Chateauroux (FR)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 361 days.

(21) Appl. No.: 12/743,174

(22) PCT Filed: Nov. 14, 2008

(86) PCT No.: PCT/US2008/083544

§ 371 (c)(1),
(2), (4) Date: Sep. 17, 2010

(87) PCT Pub. No.: WO2009/064976

PCT Pub. Date: May 22, 2009

(65) Prior Publication Data

US 2011/0132979 A1 Jun. 9, 2011

(30) Foreign Application Priority Data

Nov. 15, 2007 (GB) ..... 0722410.8

(51) Int. Cl.
*B65D 5/02* (2006.01)
*B65D 5/46* (2006.01)

(52) U.S. Cl.
USPC ..... 229/103.2; 206/139; 206/156

(58) Field of Classification Search
USPC ..... 229/141; 206/155, 156, 157, 435, 206/143, 430, 429, 161, 141, 140, 139, 162
See application file for complete search history.

(56) References Cited

U.S. PATENT DOCUMENTS

| | | | | |
|---|---|---|---|---|
| 3,203,584 | A * | 8/1965 | Forrer | 206/140 |
| 3,204,814 | A * | 9/1965 | Mahon | 206/162 |
| 4,022,372 | A * | 5/1977 | Graser | 206/193 |
| 4,747,487 | A * | 5/1988 | Wood | 206/429 |
| 4,919,266 | A | 4/1990 | McIntosh, Jr. et al. | |
| 5,180,054 | A | 1/1993 | Bakx | |
| 5,328,030 | A | 7/1994 | Sutherland | |
| 5,542,536 | A | 8/1996 | Sutherland | |
| 2006/0191811 | A1 | 8/2006 | Fogle et al. | |
| 2007/0017839 | A1* | 1/2007 | Sutherland | 206/427 |
| 2007/0241017 | A1 | 10/2007 | Sutherland | |
| 2011/0284622 | A1* | 11/2011 | Boukredine | 229/103.2 |

FOREIGN PATENT DOCUMENTS

| | | |
|---|---|---|
| EP | 0044169 | 11/1985 |
| EP | 0520411 | 12/1992 |
| EP | 0446042 | 3/1994 |

* cited by examiner

*Primary Examiner* — Nathan J Newhouse
*Assistant Examiner* — Christopher Demeree
(74) *Attorney, Agent, or Firm* — MWV Intellectual Property Group

(57) ABSTRACT

A carton (90) for packaging articles comprises top (14) and bottom (18, 20) panels connected together by spaced side walls (12, 16) to form a tubular structure, and a set of end panels (22*a*, 22*b*, 22*c*, 22*d*) at each end of the tubular structure. Each set of end panels comprises a pair of lower end closure panels (26*a*, 26*b*) connected to the side walls respectively. Each lower end closure panel is hingedly interconnected by gusset panel (34*a*, 34*b*) to an anchoring panel (24*a*, 24*b*) hinged to an adjacent one of the side wall panels. Each anchoring panel extends into the tubular structure and tucked between the adjacent side wall panel and an adjacent article. One of the gusset panels (34*a*, 34*b*) is hinged to the adjacent side wall panel (12, 16) by a hinge line (27*a*, 27*b*).

12 Claims, 13 Drawing Sheets

CARTON AND CARTON BLANK

FIELD OF THE INVENTION

The present invention relates to a carton and blank for forming the same. More specifically but not exclusively to a carton having a substantially tubular structure, said carton being of the wraparound type and optionally having means for automatically folding an end panel so as to at least partially close an end of the tubular structure.

BACKGROUND OF THE INVENTION

Wraparound type carton blanks typically comprise plurality of panels foldably hinged to each other for forming top, base and side walls. It is also known to provide an end closure structure of at least partially closing the end of the wraparound carton such a carton is shown in EP 0446042 to Bakx.

It is desirable to increase the security of the articles within the carton to prevent theft of the articles from the carton. It is also desirable to provide means for carrying a package.

SUMMARY OF INVENTION

According to a first aspect of the invention there is provided a carton for packaging a plurality of articles such as bottles or cans, which carton comprises top and bottom panels connected together by spaced side wall panels thereby forming a tubular structure and a set of end panels at each end of the tubular structure for at least partially closing that end of the tubular structure, each set of said end panels comprising a pair of lower end closure panels connected to the side wall panels respectively to at least partially close a lower part of the respective end, each of said lower end closure panels being hingedly interconnected by a gusset panel to an anchoring panel hinged to an adjacent one of the side wall panels by a first hinged connection, said anchoring panel extends sufficiently internally of the tubular structure to permit the anchoring panel to be tucked between the adjacent side wall panel and an adjacent article to retain said each lower end closure panel in a closed position wherein one of said gusset panels is hinged to an adjacent one of the side wall panels by a hinge line.

Preferably, said one gusset panel is directly hinged to said adjacent one of the side wall panels.

Preferably, the carton further comprises a bottom end flap hinged to said bottom panel and secured to respective outside surfaces of the lower end closure panels Preferably, said first hinged connections each comprise a fold line, and said hinge line is disposed co-linear with an adjacent one of said fold lines.

Preferably, said one gusset panel is triangular in shape.

Preferably, the bottom end flap only partially overlaps with the lower end closure panels.

Preferably, the bottom end flap only partially extends between the spaced side wall panels.

Preferably, the bottom end flap together with the lower end closure panels fully extend between spaced side wall panels.

According to a second aspect of the invention there is provided a carton blank for forming a carton for packaging a plurality of articles such as bottles or cans, which blank comprises top and bottom panels connected together by spaced side wall panels whereby forming a tubular structure in a setup carton and a set of end panels for at least partially closing that end of the tubular structure, each set of said end panels comprising a pair of lower end closure panels connected to the side wall panels respectively to at least partially close a lower part of the respective end, each of said lower end closure panels being hingedly interconnected by a gusset panel to an anchoring panel hinged to an adjacent one of the side wall panels by a fold line, said anchoring panel extends sufficiently internally of the tubular structure to permit said anchoring panel to be tucked between the adjacent side wall panel and an adjacent article wherein one of said gusset panels is hinged to an adjacent one of the side wall panels by a hinge line.

Preferably, said one gusset panel is directly hinged to said adjacent one of the side wall panels.

Preferably, the blank further comprises a bottom end flap hinged to said bottom panel and securable to the lower end closure panels.

Preferably, said hinge line is disposed co-linear with an adjacent one of said fold lines.

Preferably, the bottom end flap is spaced and separated from the lower end closure panels.

Preferably, the bottom end flap only partially extends between the lower end closure panels.

BRIEF DESCRIPTION OF THE DRAWINGS

Exemplary embodiments of the invention will now be described with reference to the accompanying drawings in which.

DETAILED DESCRIPTION OF EXEMPLARY EMBODIMENTS OF THE PRESENT INVENTION

Figure 1:
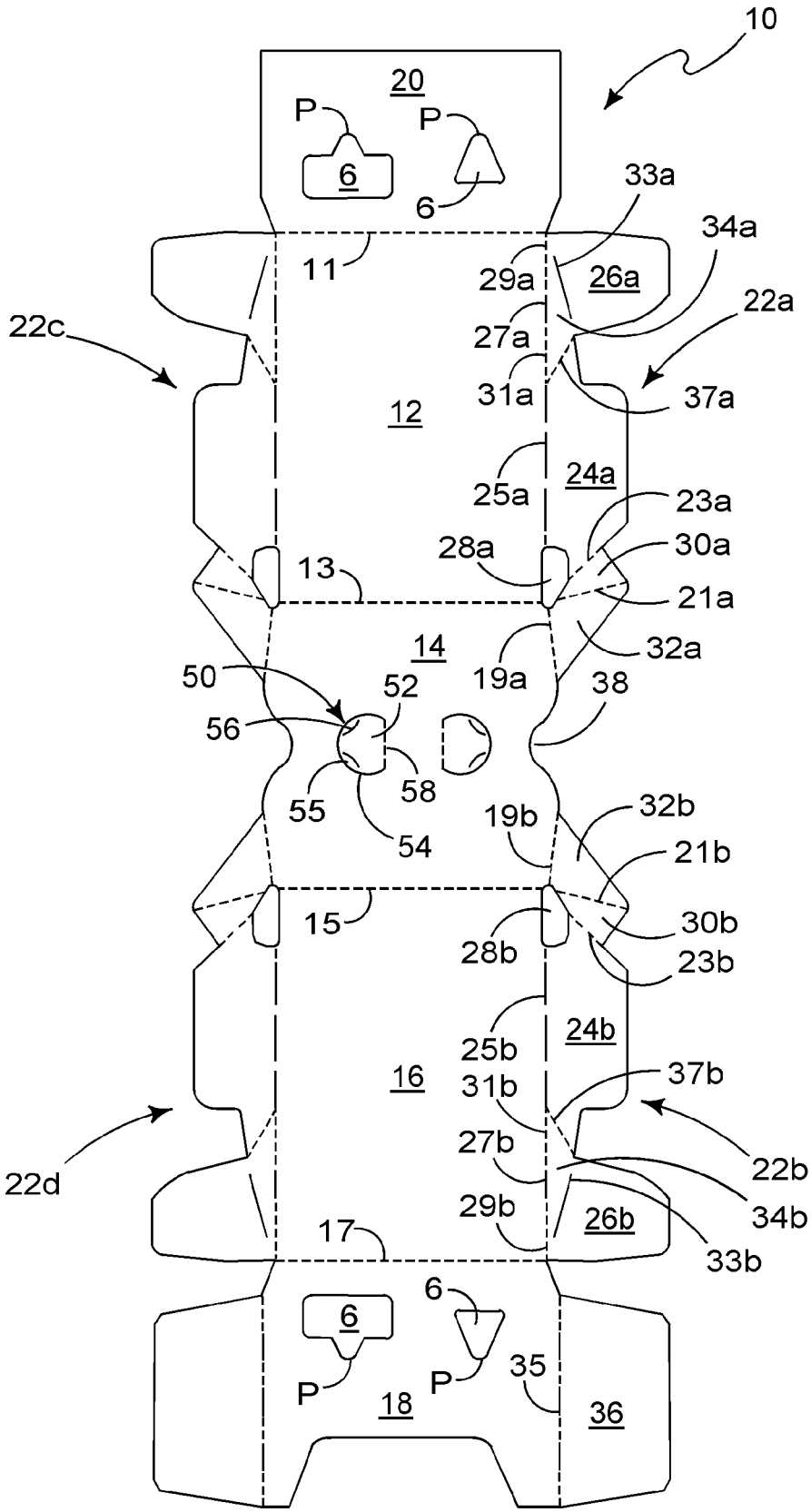
FIG. 1 shows a plan view of a blank for forming a carton according to a first embodiment of the present invention.

FIG. 1 shows a blank 10 for forming a carton 70 which blank 10 comprises a plurality of panels 12, 14, 16, 18, 20 for forming a base wall 18, 20 a pair of opposed side walls 12, 16 and a top wall 14.

The plurality of panels 12, 14, 16, 18, 20 are folded about a group of articles A to form said top wall 14, opposed side walls 12, 16 and base wall 18, 20.

Panels 18 and 20 overlap to form a composite base wall 18 and 20 that may be secured together using mechanical locking means or adhesive securing means known in the art.

Panels 18 and 20 each comprise a pair of apertures 6 which comprise a point P. The apertures 6 can be engaged either manual or automatically to facilitate securing the carton and for tightening the carton about a group of articles A.

Each opposed side wall 12, 16 comprises two pairs of end closure structures 22*a*, 22*b*; 22*c*, 22*d*. End closure structures 22*a*, 22*b*, 22*c*, and 22*d* are substantially the same in construction; therefore only one pair of end closure structures 22*a*, 22*b* will be described in detail.

Each end closure structure 22*a*, 22*b* comprises a securing panel or anchoring panel 24*a*, 24*b* hinged to a respective one of the opposed side walls 12, 16 along fold lines 25*a*, 25*b* respectively. A top end flap 32*a*, 32*b* is hinged to a top panel 14 along fold lines 19*a*, 19*b* respectively. The top end flaps 32*a*, 32*b* are hinged to gusset panels 30*a*, 30*b* along fold lines 21*a*, 22*b* respectively. Gusset panels 30*a*, 30*b* are in turn hinged to securing panels 24*a*, 24*b* along fold lines 23*a*, 23*b* respectively. Gusset panels 30*a*, 30*b* interconnect top end flaps 32*a*, 32*b* and securing panels 24*a*, 24*b* respectively.

Apertures 28*a*, 28*b* are struck from: top panel 14, a respective one of opposed side panels 12, 16 and respective ones of top end flaps 32*a*, 32*b* gusset panels 30*a*, 30*b* and securing panels 24*a*, 24*b*. Apertures 28*a*, 28*b* facilitate folding of the end closure structures 22*a*, 22*b*.

Web panels or gusset panels 34*a*, 34*b* are hinged to securing panel 24*a*, 24*b* respectively along fold lines 37*a*, 37*b*.

Web panels 34*a*, 34*b* are also coupled to a respective one of opposed side panels 12, 16 by a pair of fold lines 29*a*, 29*b*, 31*a*, 31*b*. Fold lines 29*a*, 29*b* are separated from fold lines 31*a*, 31*b* by cut lines 27*a*, 27*b* respectively. Web panels 34*a*, 34*b* are further defined, in part, by cut lines 33*a*, 33*b*. Cut lines 33*a*, 33*b* each define a respective boundary between a respective one of web panels 34*a*, 34*b* and corresponding respective one of end closure panels 26*a*, 26*b*. Cutlines 33*a*, 33*b* facilitate folding of the end closure panels 26*a*, 26*b* with respect to the web panels 34*a*, 34*b* such that cutlines 33*a*, 33*b* are co-linear with fold lines hinging the web panels 34*a*,34*b* to the end closure panels 26*a*, 26*b*. Web panels 34*a*, 34*b* are therefore defined by three hinged connections; to the sidewall 12, 16, to the end closure panel 26*a*, 26*b* and to securing panels 24*a*, 24*b*. In the preferred embodiment web panels 34*a*, 34*b* are triangular in shape.

Top panel 14 comprises a handle having finger engaging portions 50. Finger engaging portions 50 comprise a cut line 54 which is arcuate in nature. Each end of cutline 54 is adjacent to a fold line 58, hingedly connected therebetween. Cutline 54 and fold line 58 define a flap panel 52. Flap panel 52 is displaceable from a plane defined by top panel 14. Flap panel 52 comprises a pair of arcuate cut lines 56 disposed about an edge of cutline 54 substantially opposing fold line 58. Cut lines 56 and cut line 54 define in part a pair of tabs 55. Tabs 55 facilitate displacement of flap panels 53 into the assembled carton, by deflecting that of the plane of flap panel 52 alternatively when tabs 55 are forced past articles A. A bottom end flap 36 is hinged to bottom panel 18 along fold line 35, in the preferred embodiment it is envisaged that a single end flap will be provided for each end of the carton. Bottom end flap 36 is spaced from and separated from end closure panel 26*b*, 26*d* by a cut out or recess. Additionally the base panels 18, 20 are tapered in the region of fold lines 17 and 11 which hinge base panels 18, 20 to side panels 16, 12 respectively. Similarly top panel 14 is tapered at opposing sides proximate hinged connections 13, 15 to side panels 12 and 16 respectively.

Figure 2:
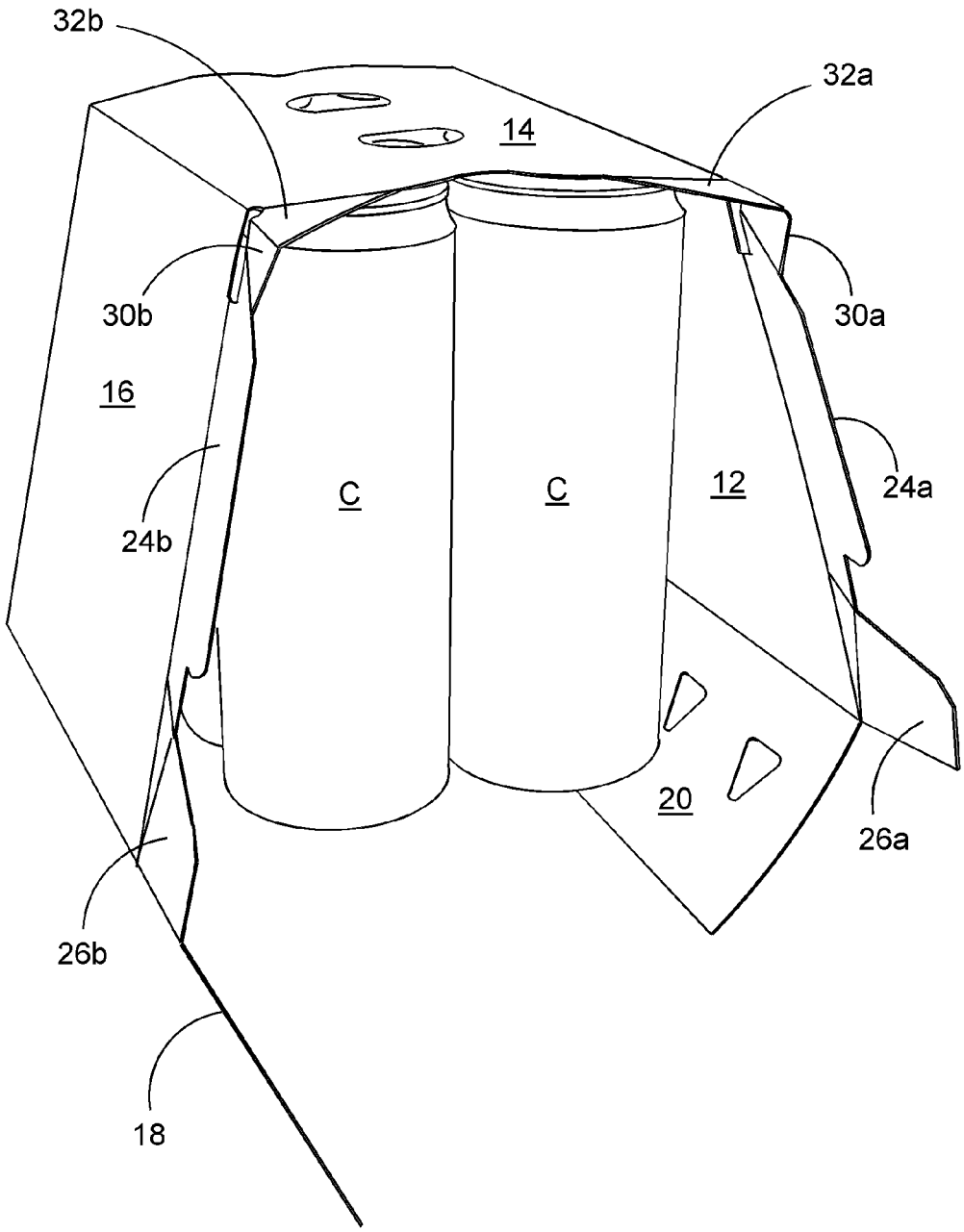
FIG. 2 illustrates a perspective view of the blank of FIG. 1 partially assembled about a group of articles.

FIGS. 2 to 5 illustrate assembly of the blank 10 into a carton 90. FIG. 2 illustrates blank 10, partially folded about a group of articles A. Top panel 14 is placed upon the group of articles A. Opposed side walls 12, 16 are folded about the group of articles A along fold lines 13, 15 respectively.

Figure 3:
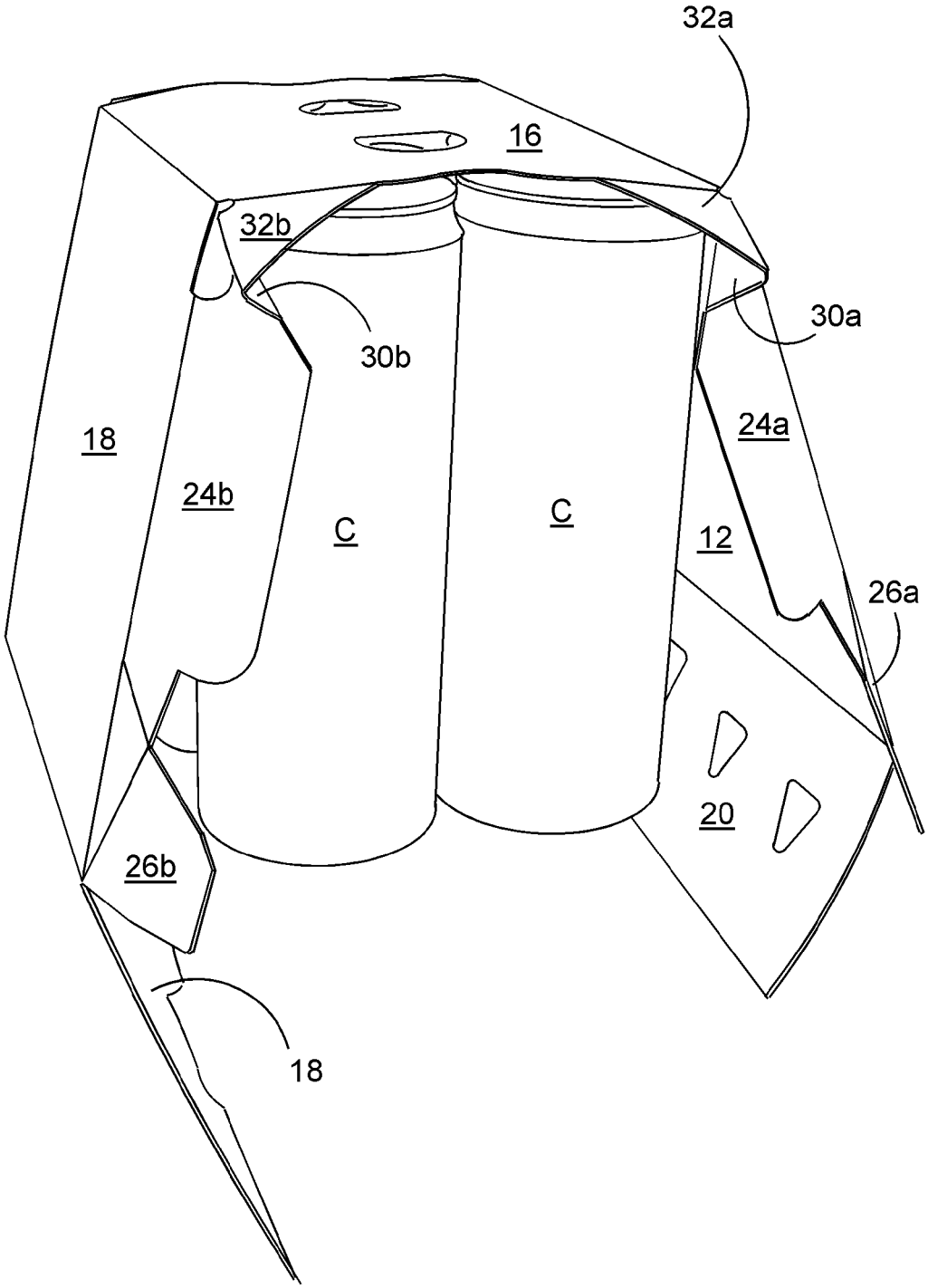
FIG. 3 illustrates a perspective view of a further stage of assembly of the blank of FIG. 1 about a group of articles.

FIG. 3 illustrates securing panels 24*a*, 24*b* being folded inwardly, whilst top end flaps 32*a*, 32*b* are folded downwardly. Gusset panels 30*a*, 30*b* are being folded between top end flaps 32*a*, 32*b* and securing panels 24*a*, 24*b*.

Figure 4:
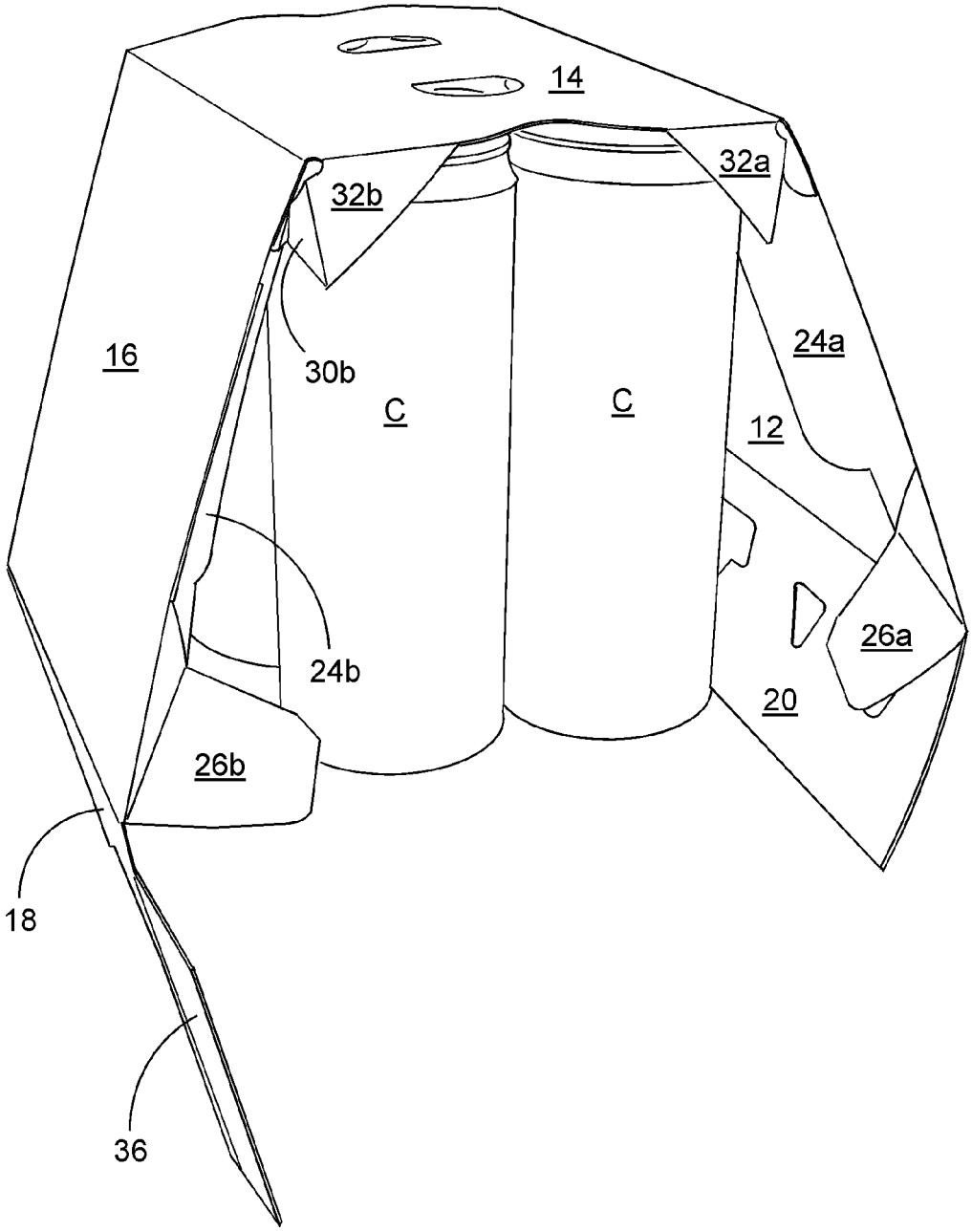
FIG. 4 illustrates a perspective view of a still further stage of assembly of the blank of FIG. 1 about a group of articles.

FIG. 4 illustrates securing panels 24*a*, 24*b* being folded between one of the respective opposed side walls 12, 16 to which it is hinged and an article adjacent that respective opposed side walls 12, 16.

In this way the article A anchors or retains the respective securing panel 24*a*, 24*b* in place. Top end flaps 32*a* and 32*b* have been folded substantially perpendicularly with the top panel 14 whereby preventing dislodgement of the article from the top of the carton 90.

Furthermore, by virtue of the provision of web panels 34*a*, 34*b* and the angled configuration of fold lines 37*a*, 37*b* and cut lines 33*a*, 33*b* end closure panels 26*a*, 26*b* remain substantially perpendicular to opposed side walls 12, 16 whereas securing panels 24*a*, 24*b* are folded substantially 180° about fold line 25*a*, 25*b* such that they are in flat face contacting relationship with a respective one of opposed side wall panels 12, 16. The end closure panels 26*a*, 26*b* only partially close the end of the carton 90. The end closure panels 26*a*, 26*b* only partially extend between the opposing side walls 12, 16.

Figure 5:
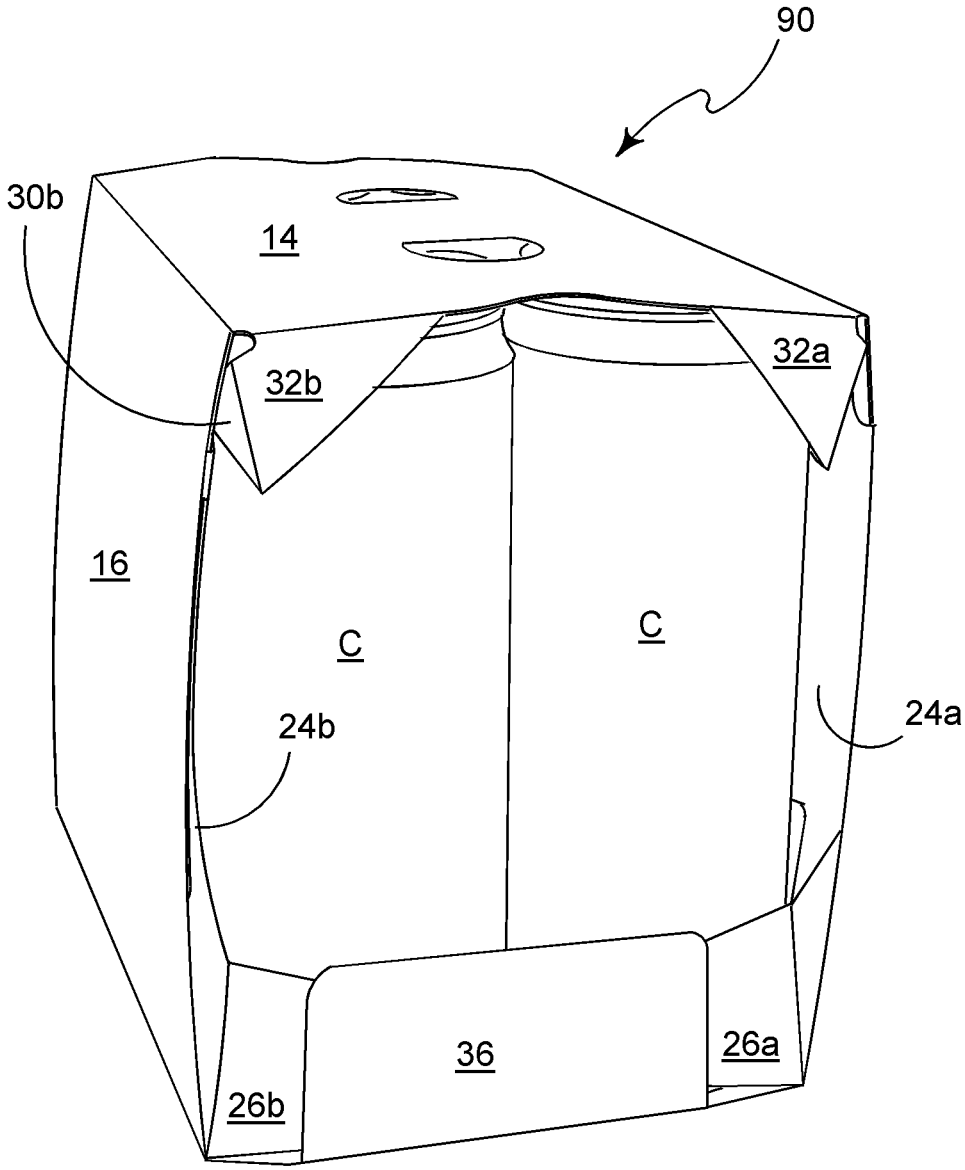
FIG. 5 illustrates a perspective view of an assembled carton according to a first embodiment of the present invention.

Turning now to FIG. 5, it can be seen that bottom end flap 36 has been secured to each of end closure panels 26*a*, 26*b*. In the preferred embodiment it is envisaged that this securing will be achieved using adhesive. The adhesive is applied to an inside surface of the bottom end flap 36 in an inline gluing process either manually or automatically however, in alternative embodiments it is envisaged that the adhesive could be applied to an outer surface of each of the end closure panels 26*a*, 26*b*. In an alternative embodiment it is envisaged that a mechanical locking means could be used in addition or alternative to adhesive. The end flap 36 only partially overlaps with the end closure panels 26*a*, 26*b*. The end flap 36 together with the end closure panels 26*a*, 26*b* extend between the opposing side walls 12, 16. The arrangement of the web panel 34*a*, 34*b* and the end closure panel 26*a*, 26*b* allow the carton to closely or tightly engage the articles C therein by folding about the curvature of the articles C.

Figure 6:
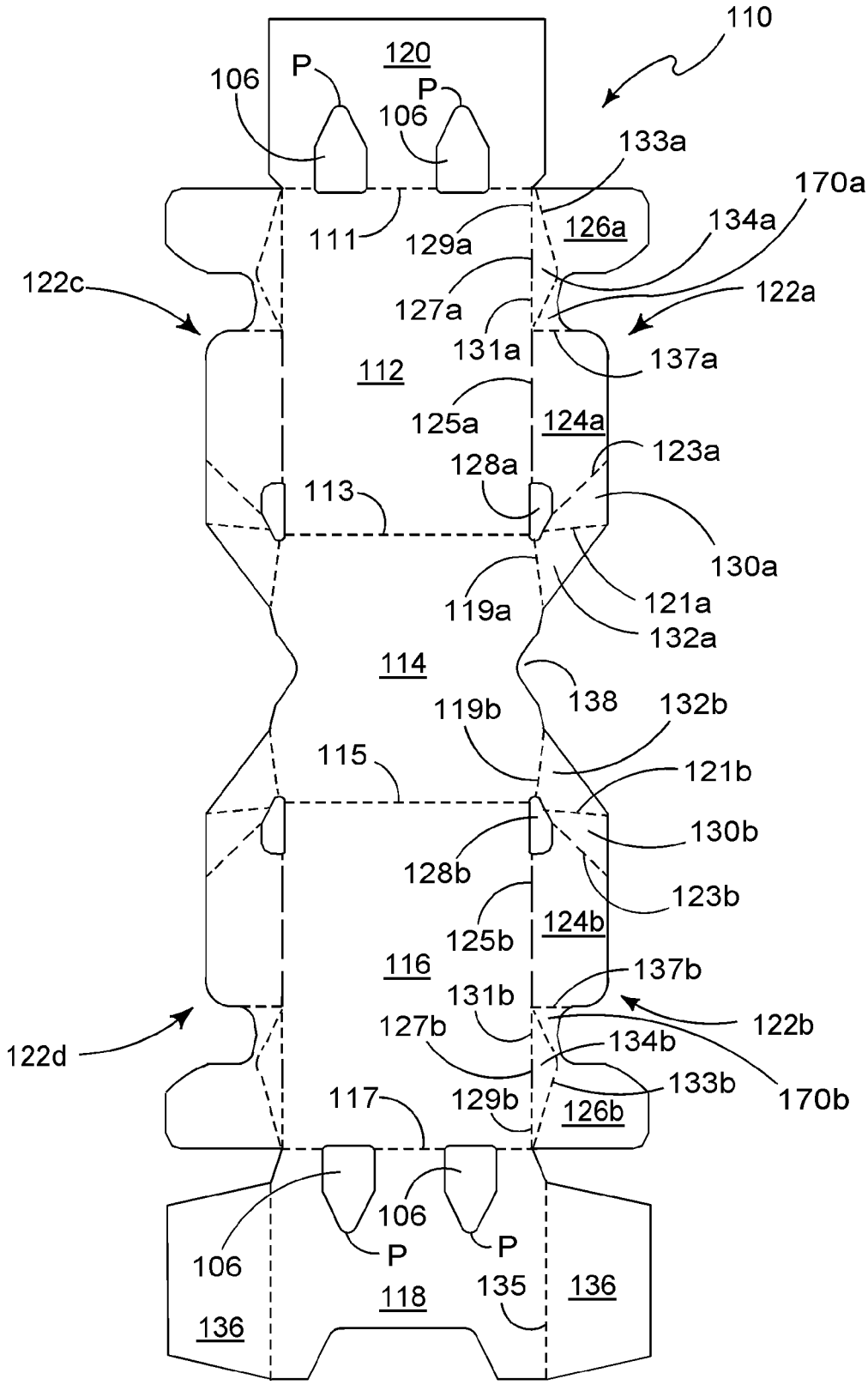
FIG. 6 shows a plan view of a blank for forming a carton according to a second embodiment of the present invention.

FIG. 6 illustrates a blank 110 according to a second embodiment of the present invention, where like parts have been designated by the same reference numeral with the prefix "1" and only the differences are described in any greater detail.

Blank 110 comprises end closure structures 122*a*, 122*b*, in which web panels 134*a*, 134*b* are defined by a "V" shaped fold line 133*a*, 133*b* the ends of which form a vertex with one of fold lines 129*a*, 129*b*, 131*a*, 131*b* respectively. A further fold line 137*a*, 137*b* extends perpendicularly to fold line 125*a*, 125*b*.

End closure panels 126*a*, 126*b* comprise an upper portion 170*a*, 170*b* defined in part by fold line 137*a*, 137*b* and "V" shaped fold line 133*a*, 133*b*.

Figure 7:
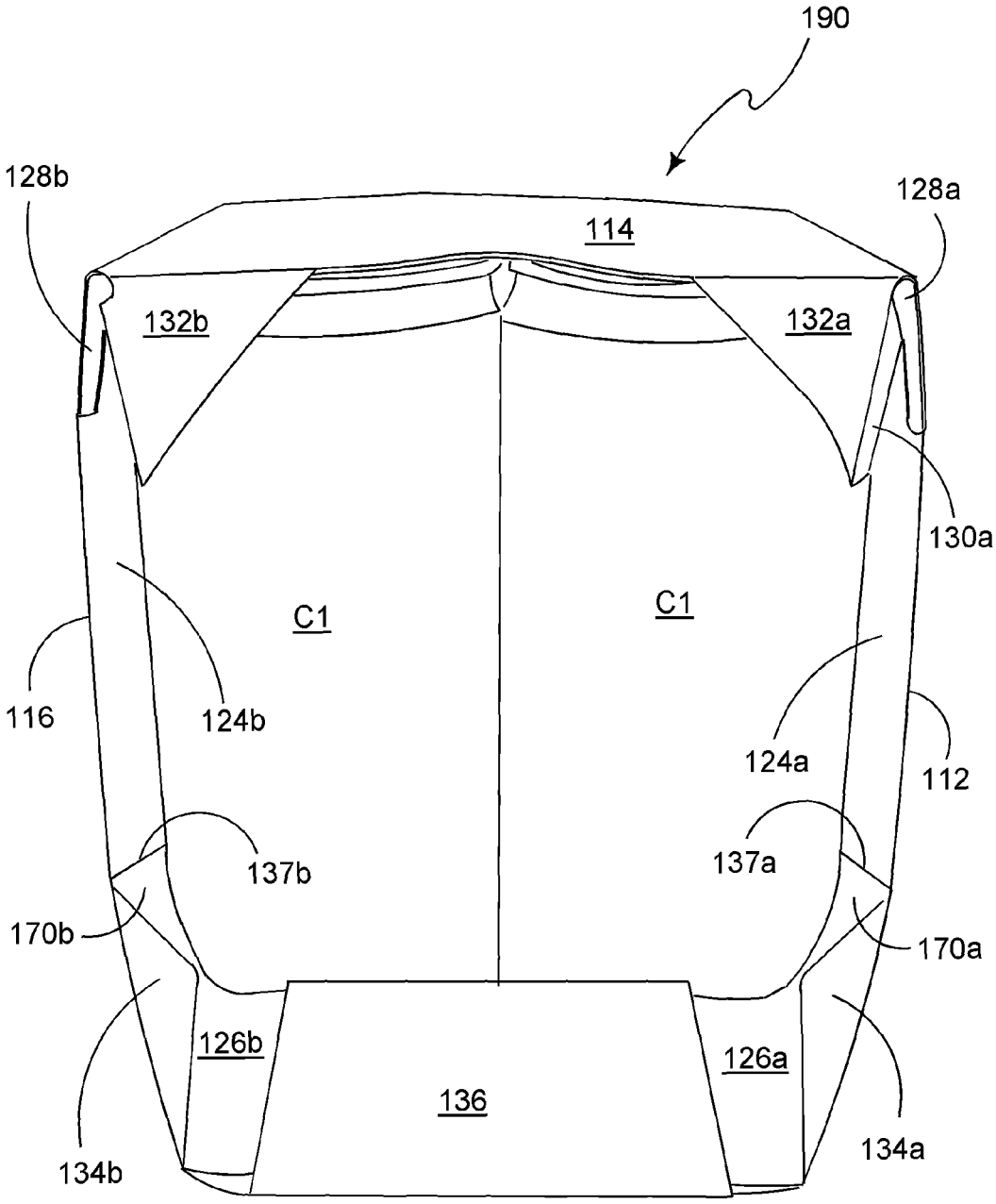
FIG. 7 illustrates a perspective view of an assembled carton according to a second embodiment of the present invention.

FIG. 7 illustrates that the arrangement of web panels 134*a*, 134*b* allows the securing panel 124*a*, 124*b* to be folded into flat face contacting relationship with a respective opposed side wall 112, 116 whilst end closure panels 126*a*, 126*b* are substantially perpendicular to the respective opposed side walls 112, 116.

It can be seen in FIG. 7 that upper portions 170*a*, 170*b* are disposed at an inclined relationship to a notional horizontal plane, in a similar manner to that of a lower region of securing panel 124*a*, 124*b* of the first embodiment. Fold line 137*a*, 137*b* facilitates the folding of the upper portion 170*a*, 170*b*.

Figure 8:
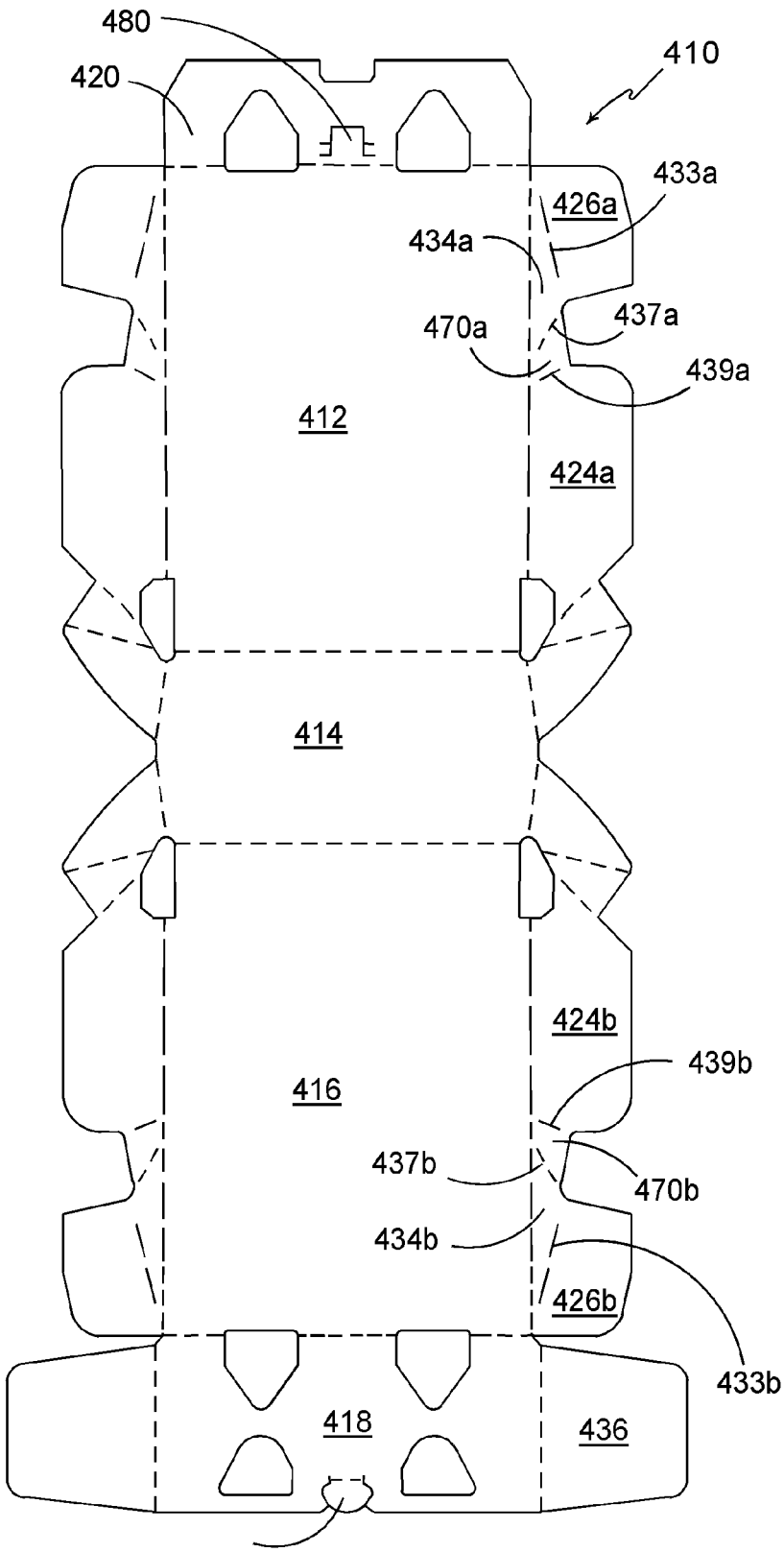
FIG. 8 shows a plan view of a blank for forming a carton according to a third embodiment of the present invention.

Turning now to FIG. 8, there is shown a blank according to a third embodiment of the present invention in which like parts have been designated with the same reference numeral with the prefix "2" and only the differences are described in detail.

Turning now to FIG. 8 there is shown a blank 410 according to a third embodiment of the present invention, the third embodiment is similar in structure to the previous embodiments, like parts are denoted with the same reference sign with the prefix "4", only differences will be described in any detail.

Blank 410 is sized and arranged to accommodate articles C arranged in an array size of 1×2 whereas the embodiments of FIGS. 1 to 7 are sized and arranged to accommodate articles arranged in an array size of 2×2.

Gusset panel 434*a*, 434*b* is defined in part by a hinge line 427*a*, 427*b* which couples it to sidewall 412, 416 respectively, which hinge line is defined by a series of spaced apart cut lines or partial cut lines. Gusset panel 434*a*, 434*b* is also defined in part by a first pair of co-linear cut lines 433*a*, 433*b* and in part by a second pair of co-linear cut lines 437*a*, 437*b*.

An additional cut line 439*a*, 439*b* is provided which together with the second pair of cut lines 437*a*, 437*b* define a tab 470*a*, 470*b* disposed between the gusset panel 434*a*, 434*b* and anchoring panel 424*a*, 424*b*.

The base panel 420 comprises a first part 480 of a mechanical lock which together with a second part 482 of the locking mechanism provided in the base panel 418 secures the base panels 420 and 418 in an at least partially overlapping configuration.

Figure 9:
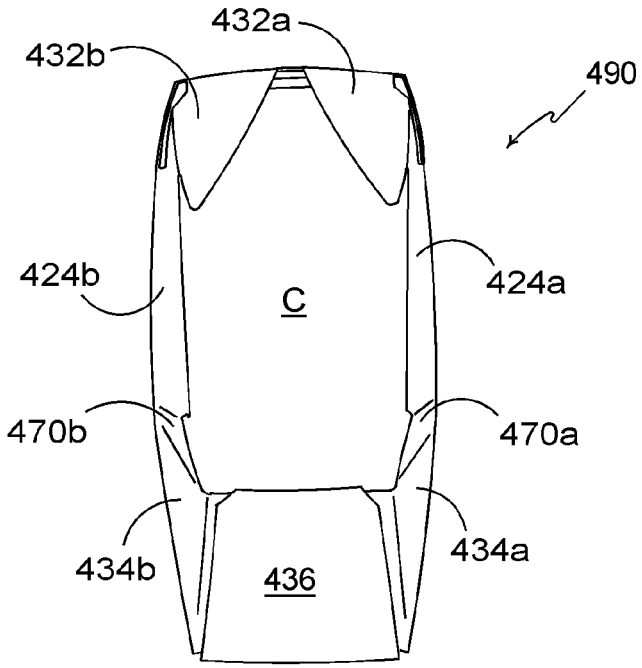
FIG. 9 illustrates a perspective view of an assembled carton according to a third embodiment of the present invention.
Figure 10:
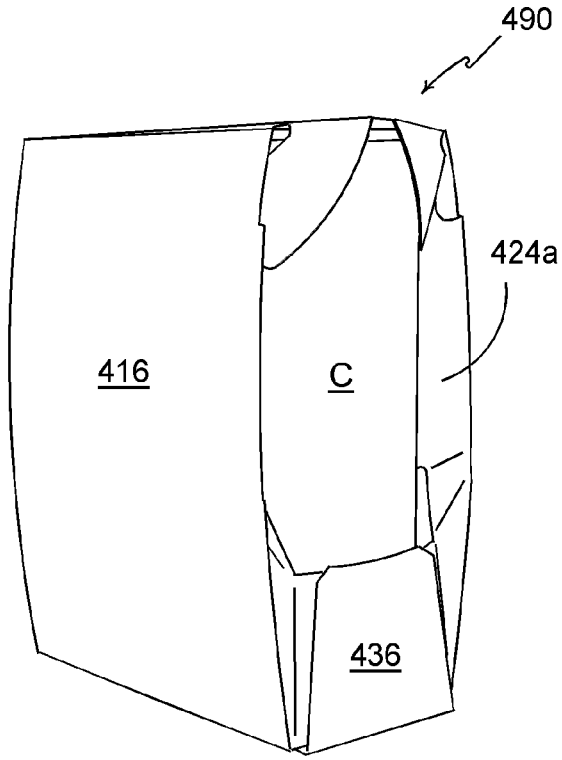
FIG. 10 illustrates a perspective view of an assembled carton according to a third embodiment of the present invention.

FIGS. 9 and 10 illustrate the blank of FIG. 8 assembled into a carton 490 about a group of articles C. The tab 470*a*, 470*b* facilitates folding of the anchoring panel 424*a*, 424*b* between the article A and the respective side wall 412, 416.

Figure 11:
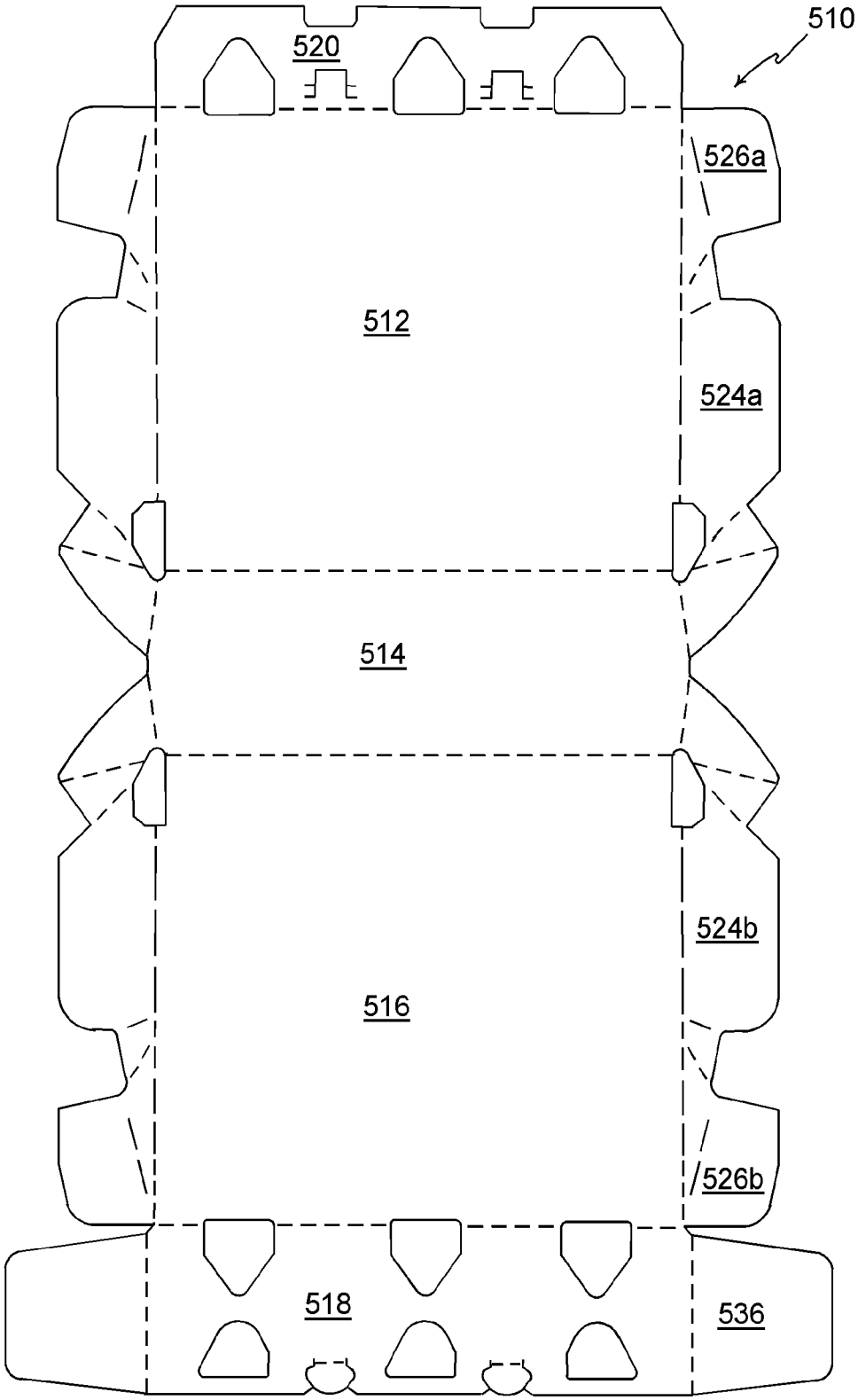
FIG. 11 shows a plan view of a blank for forming a carton according to a fourth embodiment of the present invention.

Turning now to FIG. 11 there is shown a blank 510 according to a fourth embodiment of the present invention, the fourth embodiment is similar in structure to the previous embodiments, like parts are denoted with the same reference sign with the prefix "5", only differences will be described in any detail.

Blank 510 is sized and arranged to accommodate articles arranged in an array size of 1×3.

Figure 12:
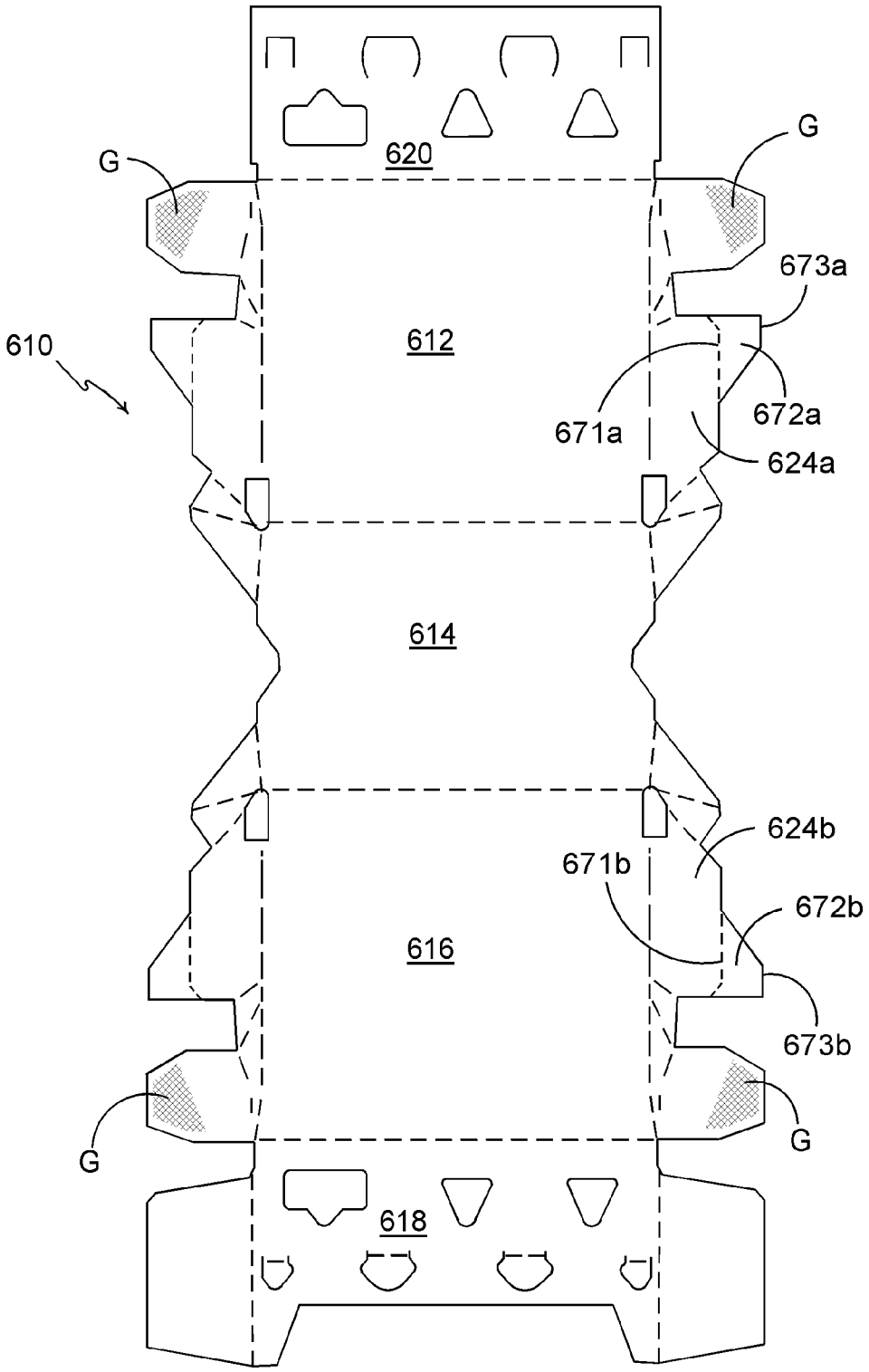
FIG. 12 shows a plan view of a blank for forming a carton according to a fifth embodiment of the present invention.

Turning now to FIG. 12 there is shown a blank 610 according to a fifth embodiment of the present invention, the fifth embodiment is similar in structure to the previous embodiment, like parts are denoted with the same reference sign with the prefix "6", only differences will be described in any detail.

Blank 610 is sized and arranged to accommodate articles arranged in an array size of 2×3.

Blank 610 comprises a wing panel 672*a*, 672*b* coupled to each of the anchoring panels 624*a*, 624*b* respectively. The wing panel 672*a*, 672*b* extends the reach of the anchoring panel 624*a*, 624*b*, enhancing the security of the carton. The wing panel 672*a*, 672*b* is dimensioned smaller than the anchoring panels 624*a*, 624*b*. The wing panel 672*a*, 672*b* is tapered such that it is narrowest at it outermost edge 673*a*, 673*b* this facilitates easier insertion of the anchoring panel 624*a*, 624*b* between the respective side wall 612, 616 and an adjacent article C.

Figure 13:
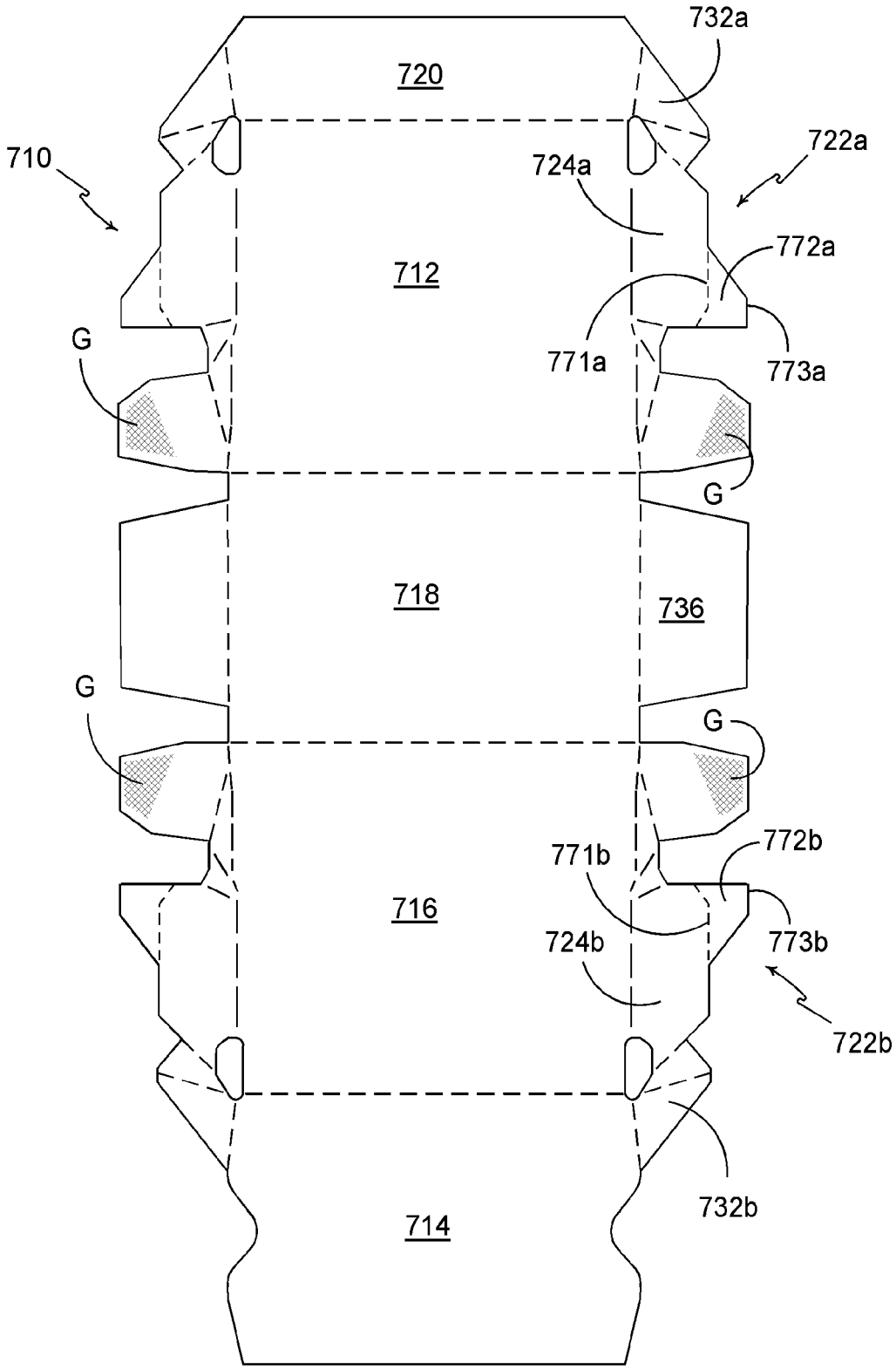
FIG. 13 shows a plan view of a blank for forming a carton according to a sixth embodiment of the present invention.

Turning now to FIG. 13 there is shown a blank 710 according to a sixth embodiment of the present invention, the sixth embodiment is similar in structure to the previous embodiments, like parts are denoted with the same reference sign with the prefix "7", only differences will be described in any detail.

Blank 710 comprises a unitary base panel 718 which is coupled on opposing sides to side wall panels 712, 716. The blank comprises a composite top panel having a first top panel 714 and a second top panel 720 an outer surface of which is secured to an inner surface of first top panel 714. First top end closure panel 732*a* is hingedly connected to first top panel 714 whereas second top end closure panel 732*b* is coupled to second top panel 720. Alternatively, the inner surface of second top panel 720 may be secured to an outer surface of first top panel 714.

Figure 14:
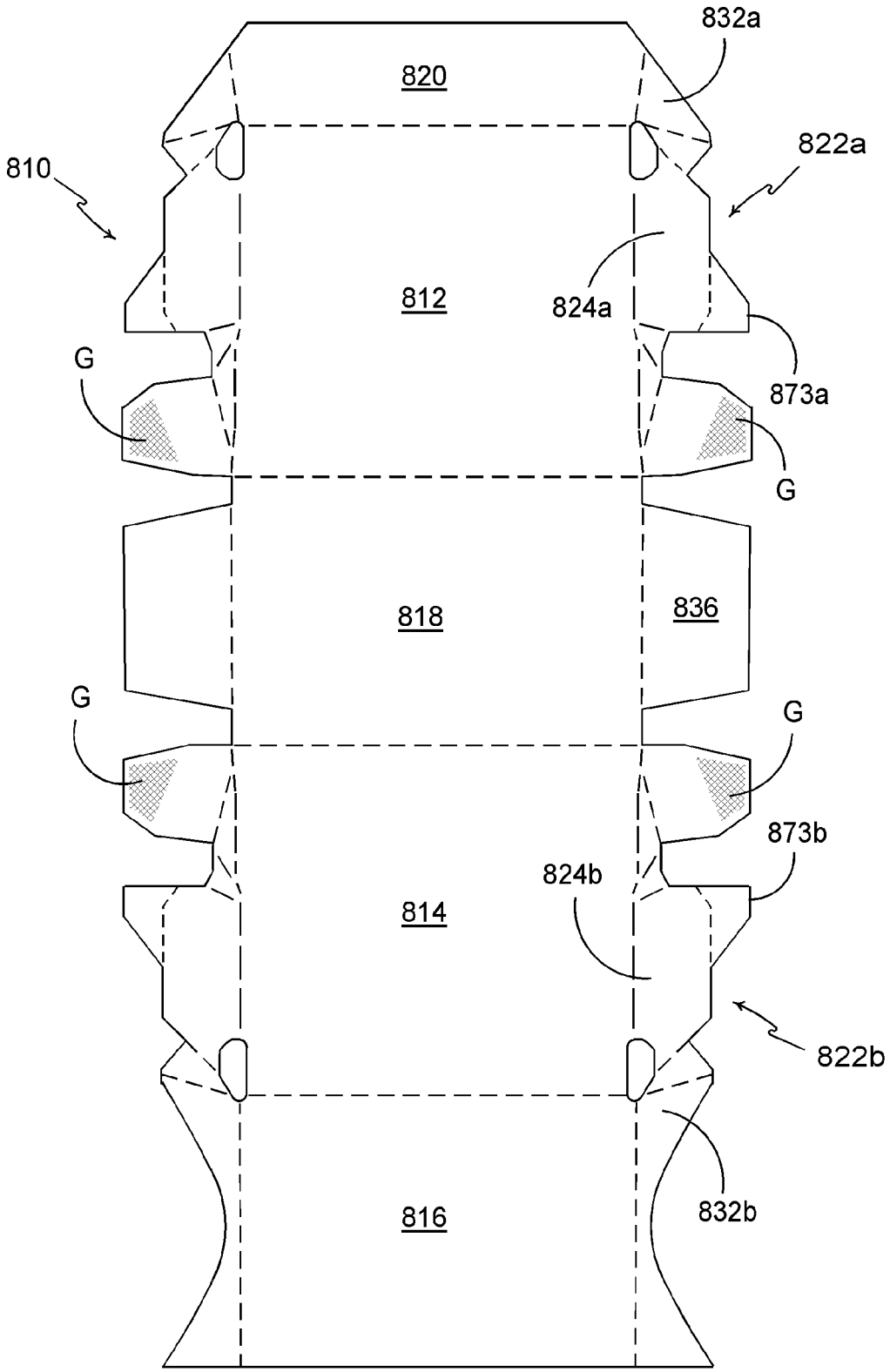
FIG. 14 shows a plan view of a blank for forming a carton according to a seventh embodiment of the present invention.

Turning now to FIG. 14 there is shown a blank 810 according to seventh embodiment of the present invention, the seventh embodiment is similar in structure to the previous embodiments, like parts are denoted with the same reference sign with the prefix "8", only differences will be described in any detail.

First top end closure panel 832*a* extends between the free edge of the first top panel 814 and the hinged connection to the second side wall panel 816. It is envisaged that a portion of the first top end closure panel 832*a* may be secured to a portion of second top end closure panel 832*b* either to an internal or external surface thereof.

It is envisaged that modification may be made in the foregoing without departing from the scope of the invention.

It should be appreciated that as used herein, directive references such as "top", "bottom", "end", "side", "upper" and "lower" do not limit the respective panels to such orientation, but merely serve to distinguish these panels from one another. It should be further appreciated that any reference to hinged or foldable connections should not be construed as necessarily referring to a single fold line only, indeed it is envisaged that hinged connection can be formed from one or more of the following, a score line, a frangible line or a fold line, without departing from the scope of the invention.

The invention claimed is:

1. A carton for packaging a plurality of articles, the carton comprising top and bottom panels connected together by a pair of first and second spaced side walls thereby forming a tubular structure and a set of end panels at each end of the tubular structure for at least partially closing the each end of the tubular structure, each set of the end panels comprising:

a pair of first and second end closure panels connected to the first and second side walls via first and second gusset panels respectively to at least partially close to a lower part of a respective one of the ends of the tubular structure; and a pair of first and second anchoring panels connected to the first and second side walls respectively, the first and second anchoring panels extending sufficiently internally of the tubular structure to permit each of the first and second anchoring panels to be tucked between an adjacent article and an adjacent one of the first and second side walls- to retain an adjacent one of the first and second end closure panels in a closed position, the first gusset panel hingedly interconnecting the first end closure panel and the first anchoring pane, the second gusset panel hingedly interconnecting the second end closure panel and the second anchoring panel, wherein at least one of the first and second gusset panels is hingedly connected to an adjacent one of the first and second side walls by a hinge line, and wherein the at least one gusset panel is directly hinged to the adjacent one of the first and second side walls.

2. The carton according to claim 1, further comprising a bottom end flap hingedly connected to the bottom panel and secured to respective outside surfaces of the first and second end closure panels.

3. The carton according to claim 2, wherein the bottom end flap only partially overlaps with the first and second end closure panels.

4. The carton according to claim 2, wherein the bottom end flap only partially extends between the first and second spaced side wall.

5. The carton according to claim 2 wherein the bottom end flap together with the end closure panels fully extend between the first and second spaced side walls.

6. The carton according to claim 1, wherein the at least one gusset panel is essentially triangular in shape.

7. A carton for packaging a plurality of articles, the carton comprising top and bottom panels connected together by a pair of first and second spaced side walls thereby forming a tubular structure and a set of end panels at each end of the tubular structure for at least partially closing the each end of the tubular structure, each set of the end panels comprising:

a pair of first and second end closure panels connected to the first and second side walls via first and second gusset panels respectively to at least partially close a lower part of a respective one of the ends of the tubular structure; and a pair of first and second anchoring panels connected to the first and second side walls respectively, the first and second anchoring panels extending sufficiently internally of the tubular structure to permit each of the first and second anchoring panels to be tucked between an adjacent article and an adjacent one of the first and second side walls to retain an adjacent one of the first and second end closure panels in a closed portion, the first gusset panel hingedly interconnecting the first end closure panel and the first anchoring panel, the second gusset panel hingedly interconnecting the second end closure panel and the second anchoring panel, wherein at least one of the first and second gusset panels is hingedly connected an adjacent one of the first and second side walls by a hinge line, and wherein the first and second anchoring panels are connected to the first and second side wall along first and second fold lines respectively, and the hinge line is disposed co-linear with an adjacent one of the first and second fold lines.

8. A blank for forming a carton for packaging a plurality of articles, the blank comprising an elongate section including a bottom panel, a first side wall, a top panel and a second side wall hingedly connected one to next, and a set of end panels hingedly connected to the elongate section along each of the opposed longitudinal edges of the elongate section, each set of the end panels comprising:

a pair of first and second end closure panels connected to the first and second side walls via first and second gusset panels respectively; and a pair of first and second anchoring panels connected to the first and second side walls respectively, the first gusset panel hingedly interconnecting the first end closure panel and the first anchoring panel, the second gusset panel hingedly interconnecting the second end closure panel and the second anchoring panel, wherein at least one of the first and second gusset panels it hingedly connected to an adjacent one of the first and second side walls by a hinge line, and wherein the at least one gusset panel is directly hingedly connected to the adjacent one of the first and second side walls.

9. The blank according to claim 8, further comprising a bottom end flap hingedly connected to the bottom panel.

10. The blank according to claim 9, wherein the elongate section further includes a second bottom panel.

11. A blank for forming a carton for packaging a plurality of articles, the blank comprising an elongate section including a bottom panel, a first side wall, a top panel and a second side wall hingedly connected one to next, and a set of end panels hingedly connected to the elongate section along each of the opposed longitudinal edges of the elongate section, each set of the end panels comprising:

a pair of first and second end closure panels connected to the first and second side walls via first and second gusset panels respectively; and a pair of first and second anchoring panels connected to the first and second side walls respectively, the first gusset panel hingedly interconnecting the first end closure panel and the first anchoring panel, the second gusset panel hingedly interconnecting the second end closure panel and the second anchoring panel, wherein at least one of the first and second gusset panels is hingedly connected to an adjacent one of the first and second side walls by a hinge line, and wherein the first and second anchoring panels are connected to the first and second side walls along first and second fold lines respectively, and the hinge line is disposed co-linear with an adjacent one of the first and second fold lines.

12. A blank for forming a carton for packaging a plurality of articles, the blank comprising an elongate section including a bottom panel, a first side wall, a top panel and a second side wall hingedly connected one to next, and a set of end panels hingedly connected to the elongate section along each of the opposed longitudinal edges of the elongate section, each set of the end panels comprising:

a pair of first and second end closure panels connected to the first and second side walls via first and second gusset panels respectively; and a pair of first and second anchoring panels connected to the first and second side walls respectively, the first gusset panel hingedly interconnecting the first end closure panel and the first anchoring panel, the second anchoring panel, wherein at least one of the first and second gusset panels is hingedly connected to an adjacent one of the first and second side walls by a hinge line, the blank further comprising a bottom end flap hingedly connected to the bottom panel, wherein the bottom end flap is spaced and separated from an adjacent one of the first and second lower end closure panels.

* * * * *